US006220120B1

(12) United States Patent
Check

(10) Patent No.: US 6,220,120 B1
(45) Date of Patent: Apr. 24, 2001

(54) ERGONOMIC TOOL

(76) Inventor: Jason D. Check, 303 N. Washington, Westmont, IL (US) 60559

( * ) Notice: Subject to any disclaimer, the term of this patent is extended or adjusted under 35 U.S.C. 154(b) by 0 days.

(21) Appl. No.: 09/371,370

(22) Filed: Aug. 10, 1999

(51) Int. Cl.[7] ..... B25G 3/34
(52) U.S. Cl. ..... 81/20; 81/177.1; 30/529
(58) Field of Search ..... 81/20, 177.1; 30/529

(56) References Cited

U.S. PATENT DOCUMENTS

| | | | | |
|---|---|---|---|---|
| D. 273,759 | | 5/1984 | Drori . | |
| 1,142,946 | * | 6/1915 | Ellis | 81/117.1 X |
| 2,656,225 | * | 10/1953 | Saylor | 81/20 X |
| 3,877,826 | * | 4/1975 | Shepherd, Jr. et al. | 81/20 X |
| 4,363,344 | | 12/1982 | Pollak . | |
| 4,399,978 | | 8/1983 | Moore . | |
| 4,805,494 | | 2/1989 | Santoro . | |
| 5,062,324 | | 11/1991 | Saviano . | |
| 5,125,130 | | 6/1992 | Stanish . | |
| 5,161,293 | | 11/1992 | Ebbert . | |
| 5,280,738 | | 1/1994 | Liou . | |
| 5,588,343 | * | 12/1996 | Rust et al. | 81/20 X |

* cited by examiner

*Primary Examiner*—James G. Smith
*Assistant Examiner*—Anthony Ojini
(74) *Attorney, Agent, or Firm*—Charles F. Meroni, Jr.; Meroni & Meroni, P.C.

(57) ABSTRACT

A pounding head is mounted onto a handle at an offset with respect to the handle in order to align the pounding head with the forearm. In the preferred embodiment, this offset is defined by an angle β created between a first reference plane extending through the axial center of the pounding head and bisecting the pounding head and a second reference plane extending through the axial center of the handle, bisecting the handle along its front and rear portion.

23 Claims, 6 Drawing Sheets

ERGONOMIC TOOL

BACKGROUND OF THE INVENTION

1. Field of the Invention

The present invention relates to hand held pounding instruments such as hammers and mallets.

2. Description of the Prior Art

Using a hand held pounding instrument such as a hammer or a mallet to drive a spiked object such as a nail or a tack into a surface is a precise and often arduous task. In order to optimize the work accomplished with each stroke of the pounding instrument, it is imperative that the pounding instrument deliver the maximum amount of force to the spiked object with each strike and the pounding instrument must deliver this force at the optimal angle so as to drive the spiked object straight into the surface. The result of an inaccurate hit on the nail or other spiked object will typically result in the need to perform additional strikes to complete the task or may even result in the damaging of the nail or other spiked object requiring the user to remove the nail and start over with a new nail.

There are a variety of hand held pounding instruments in the prior art which can be used to drive a spiked object through a surface. These pounding instruments typically consist of a handle and a pounding head. The pounding head has a pounding surface, and both the pounding surface and the pounding head are typically aligned to the handle so that a reference plane running through the axial center of the pounding surface, bisecting the pounding head, will also serve to bisect the handle through the axial center of the handle along its front and rear portion.

One of the drawbacks to the prior art is that the pounding head and the pounding surface will typically not align with the forearm when the pounding instrument is grasped by the hand in a normal fashion. Due to the skeletal structure of the hand, grasping a typical handle for a pounding instrument in a normal fashion, with (FIGS. 5 and 6) the fingers, other than the thumb, resting across the front portion of the handle, will turn the handle anywhere from 6.5° to 9.5° from a line across the center of the forearm defined by the radius (FIGS. 3 and 4). This in turn results in an offset angle of 6.5° to 9.5° between the pounding head and a line across the center of the forearm defined by the radius.

Due to this offset between the forearm and the pounding surface, the prior art pounding instruments requires substantial movement by the wrist in order to generate an accurate hit on a spiked object such as a nail or a tack. Typically, when an accurate hit is required on a spiked object, the user generates a stroke of the pounding instrument by the controlled movement of the wrist with little help from the forearm.

The bones which comprise the wrist are small and so are the muscles which attach to the bones. As a result, the wrist does not have the leverage to generate as much power as the longer bones in the arm like the radius, and since the muscles in the wrist are smaller they fatigue significantly quicker than the longer muscles which are attached to the longer bones in the arm. Subsequently, in order to generate greater power in a single stroke of a pounding instrument, and in order to minimize fatigue, the forearm must be incorporated in the pounding stroke, and movement of the wrist must be minimized.

Consequently, significant improvement in the design of a pounding instrument can be achieved by designing a pounding instrument which aligns the pounding head and the pounding surface to the forearm, specifically the radius bone. By doing so, the pounding stroke can be changed in order to provide greater accuracy and power. If the pounding head is aligned to the forearm, the wrist can remain locked while the forearm is used to drive the pounding instrument.

Accordingly, there is a need for a pounding instrument with a pounding head and pounding surface that is ergonomically aligned with the forearm in order to minimize the involvement of the wrist in a pounding stroke and to maximize the involvement of the forearm.

The present invention is an ergonomically designed pounding instrument having a built in offset which allows the pounding head and the pounding surface to align with the forearm when gripped in a normal fashion.

As will be described in greater detail hereinafter, the present invention solves the aforementioned and employs a number of novel features that render it highly advantageous over the prior art.

SUMMARY OF THE INVENTION

Accordingly it is an object of this invention to provide an ergonomically designed pounding instrument having a built in offset which allows the pounding head and the pounding surface to align with the forearm when gripped in a normal fashion, allowing the user to maximize the use of the forearm in the pounding stroke while minimizing the movement of the the wrist.

To achieve these objectives, and in accordance with the purposes of the present invention the following ergonomically designed pounding instrument is presented.

A pounding head is mounted onto a handle at an offset with respect to the handle in order to align the pounding head with the forearm. In the preferred embodiment, this offset is defined by an angle $\beta$ created between a first reference plane extending through the axial center of the pounding head and bisecting the pounding head and a second reference plane extending through the axial center of the handle, bisecting the handle along its front and rear portion.

In order to align the pounding head and the pounding surface to the forearm, the angle should be greater than or equal to 6.5° and less than or equal to 9.5°. In the preferred embodiment, the angle $\beta$ is 8°. Due to the skeletal structure of the hand, grasping a typical handle for a pounding instrument in a normal fashion, with the (FIGS. 5 and 6) fingers, other than the thumb, resting across the front portion of the handle, will turn the handle an angle $\theta$ from a line across the center of the forearm defined by the radius, $\theta$ being anywhere from 6.5° to 9.5°. By offsetting the pounding head by the angle $\beta$, the misalignment between the pounding surface and the forearm resulting from the normal grasping of the handle is significantly reduced or eliminated.

Once the pounding head and the pounding surface is aligned to the forearm. The pounding stroke can be changed to incorporate the forearm and minimize any movement of the wrist. The resulting pounding stroke will involve grasping the pounding instrument in a normal fashion, locking the wrist, and radially moving the forearm about the elbow. When viewed from the side, the forearm moves radially in a counterclockwise fashion to deliver a blow and moves radially in a clockwise fashion to recoil. The length of this new pounding stroke builds greater acceleration in the pounding head and the pounding surface, resulting in greater power being delivered with each blow. Furthermore, since there is no wrist manipulation involved in this new pounding stroke, greater accuracy can also be achieved with each stroke.

Other objects, features, and advantages of the invention will become more readily apparent upon reference to the following description when taken in conjunction with the accompanying drawings.

DESCRIPTION OF THE PREFERRED EMBODIMENT

Figure 1:
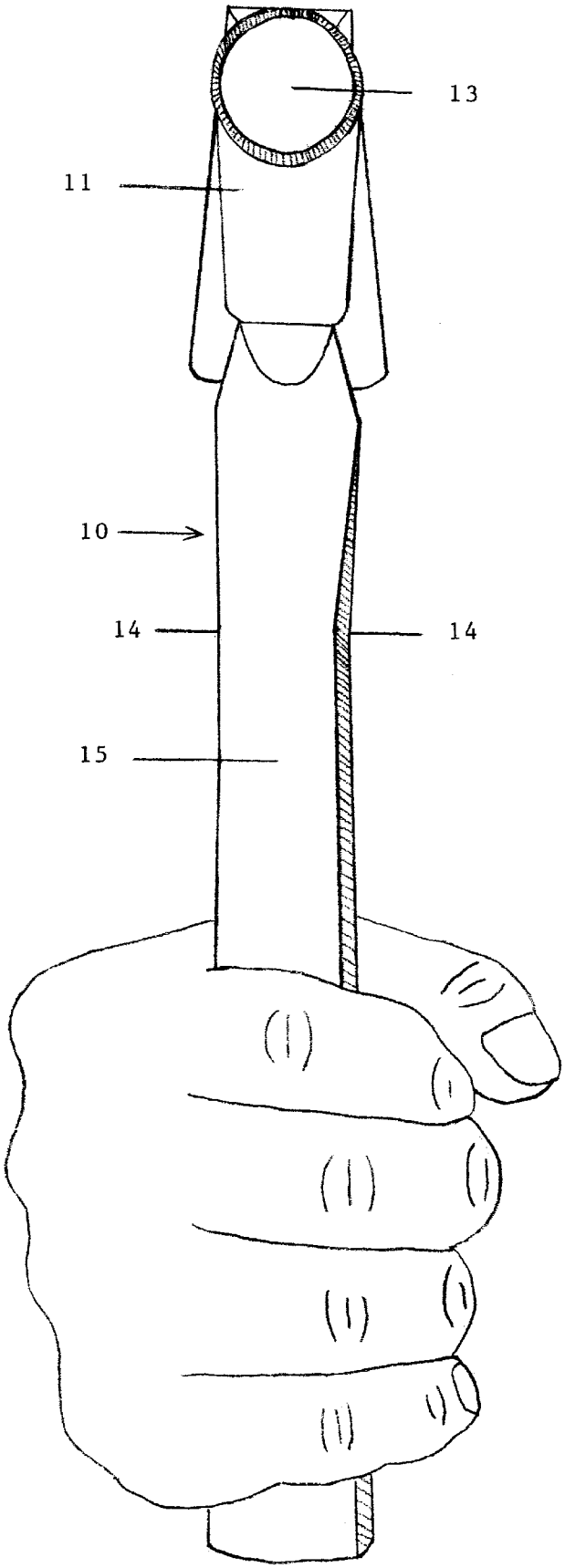
FIG. 1 a front view of my invention being grasped in a normal fashion.
Figure 2:
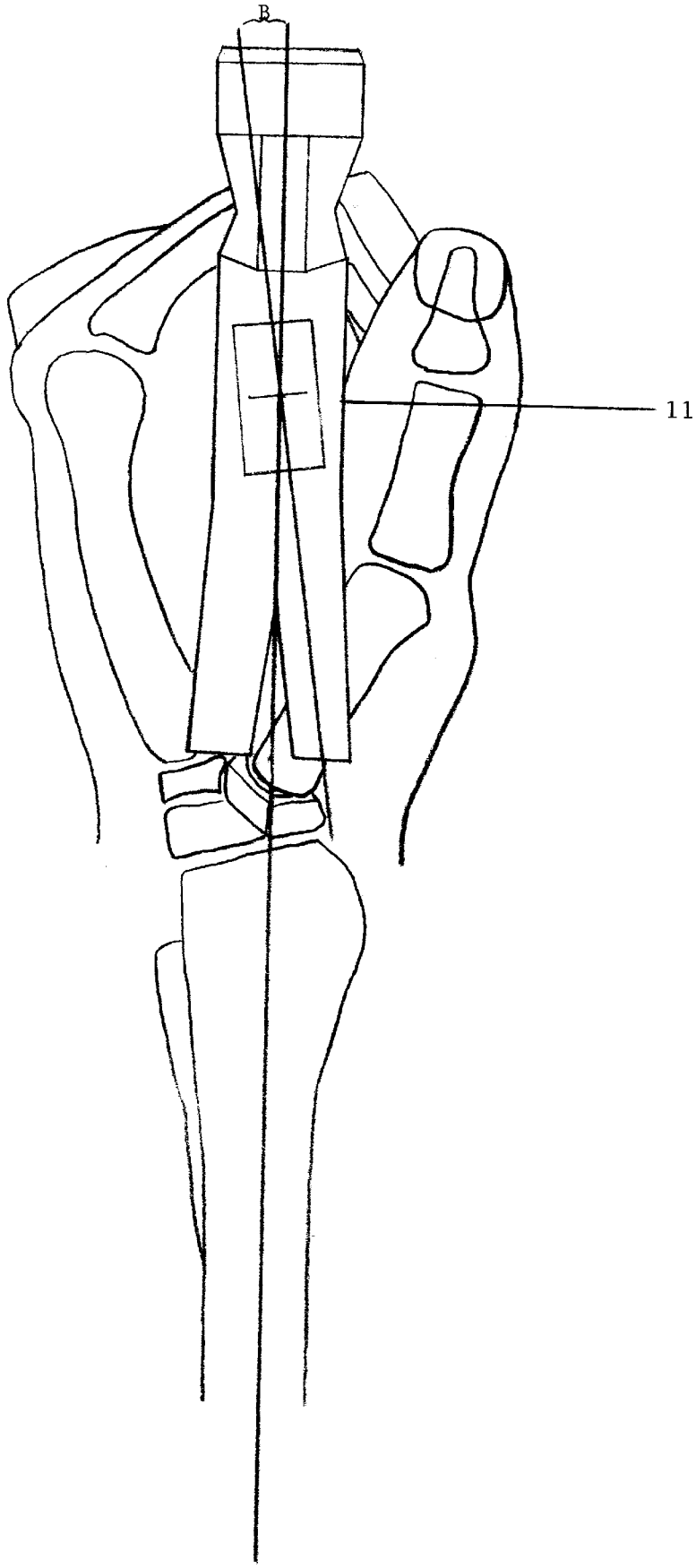
FIG. 2 is an overhead planar view of my invention with the bone structure of the hand disclosed.
Figure 3:
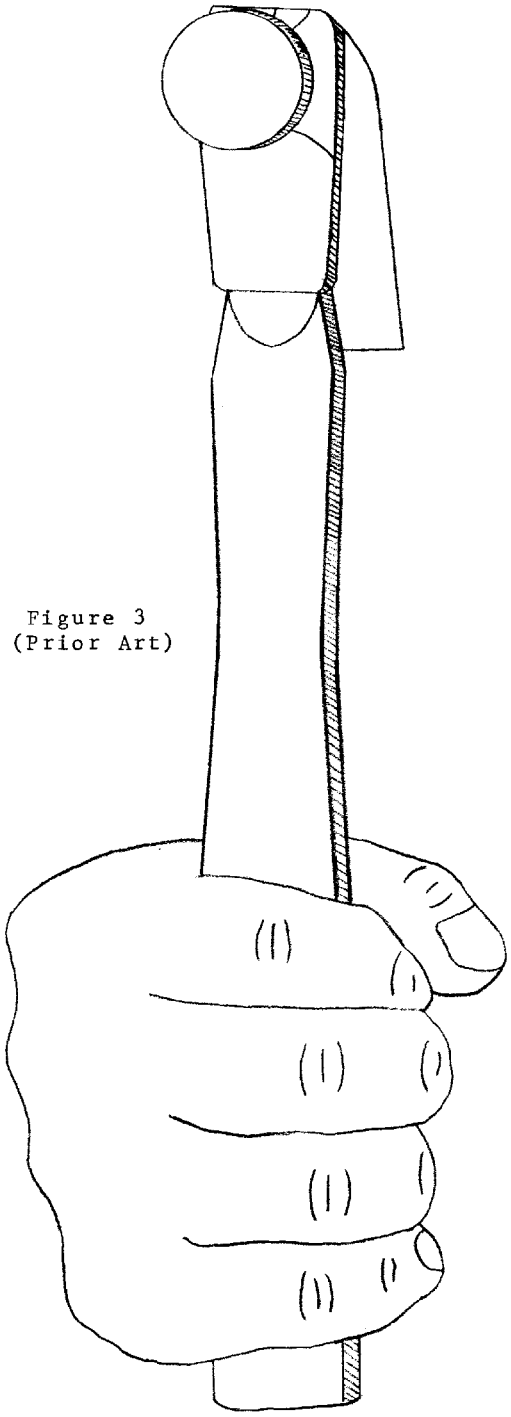
Figure 3 (Prior Art)
FIG. 3 is a front view of the prior art being grasped in a normal fashion.
Figure 4:
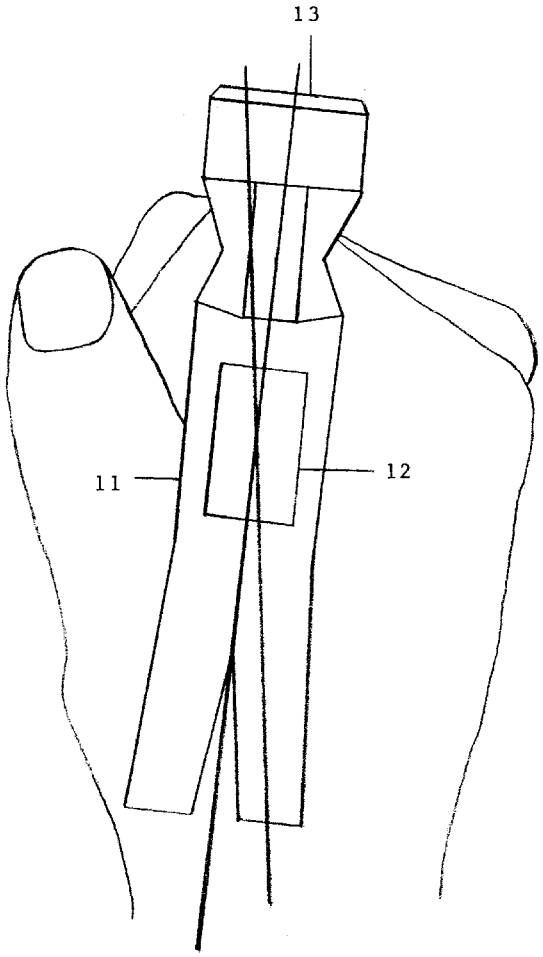
Figure 4 (Prior Art)
FIG. 4 is an overhead planar view of the prior art being grasped in a normal fashion.

The present invention is an ergonomically designed pounding instrument having a pounding head and a pounding surface aligned to the radius in the forearm when the pounding instrument is gripped in normal fashion.

Referring to FIGS. 1, 7, 4 and 8, in the preferred embodiment, a standard pounding head 11 having a handle mount portion 12 and a relatively planar pounding surface 13 is mounted to an offset handle 10 comprising of two side portions 14, a front portion 15, a rear portion 16, and an offset head mount portion 17. In the preferred embodiment, the pounding head is a hammer head, but mallet heads and other forms pounding heads may be used. The head mount portion 17 of the offset handle 10 is disposed within the handle mount portion 12 of the pounding head 11. The head mount portion 17 is typically rectangular in shape to correspond with the typically rectangular handle mount portion 12 of a standard pounding head 11. But other corresponding shapes can be used. The offset head mount portion 17 enables a standard pounding head 11 to be mounted at an offset with respect to the handle 10.

Figure 8:
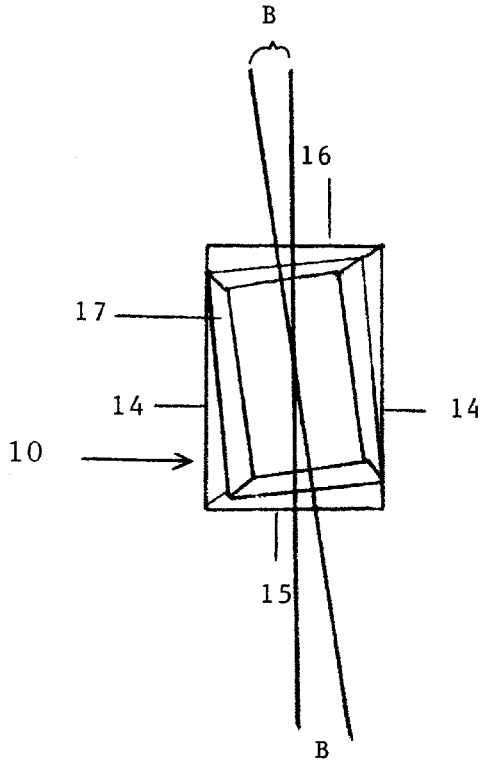
FIG. 8 is an overhead planar view of the handle in FIG. 7 showing features.

Referring to FIG. 8, the offset is defined by an angle β created between a first reference plane extending through the axial center of the pounding head and bisecting the pounding head and a second reference plane extending through the axial center of the handle, bisecting the handle along its front and rear portion. In the preferred embodiment, the angle β, is also created between between a first reference plane extending through the axial center of the head mount portion 17 of the offset handle 10 bisecting the head mount portion 17 and a second reference plane extending through the axial center of the handle 10, bisecting the handle along its front 15 and rear 16 portions.

Figure 6:
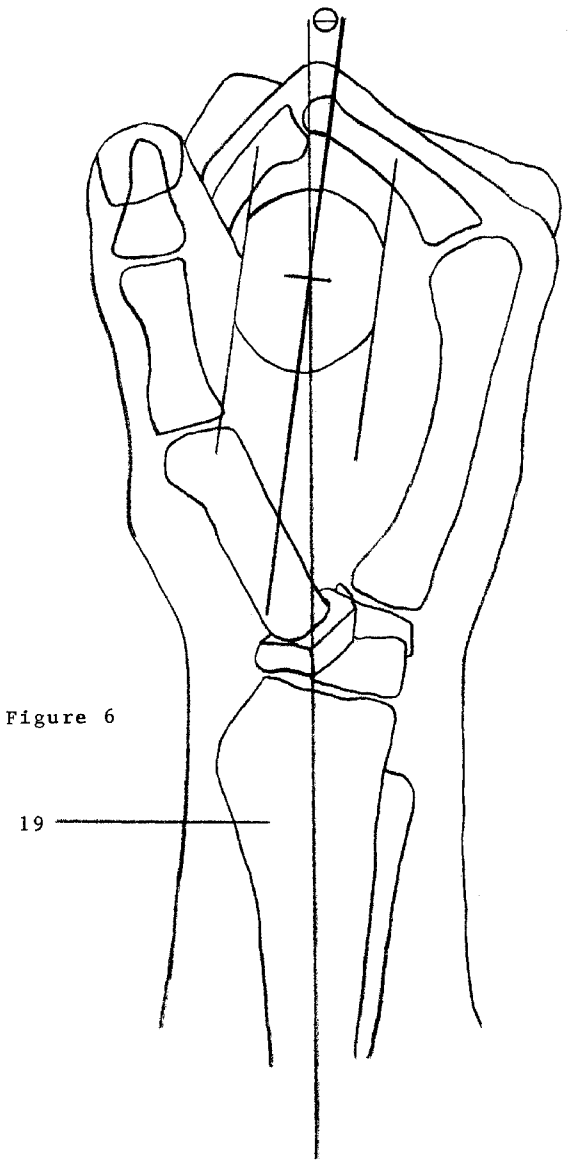
FIG. 6 is an overhead planar view of a handle being grasped in a normal fashion with the bone structure in the hand disclosed.
Figure 5:
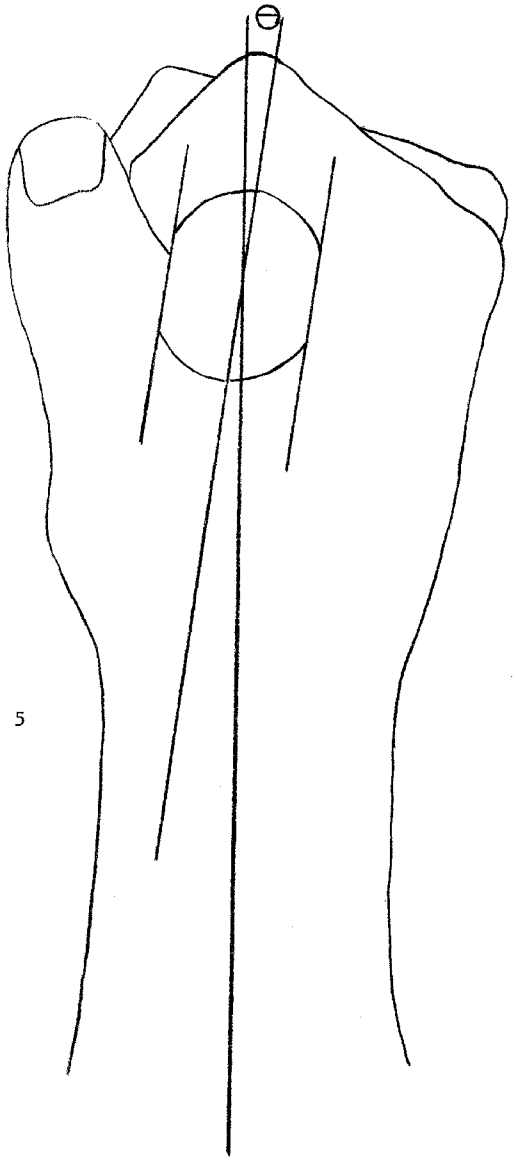
FIG. 5 is an overhead planar view of a handle being grasped in a normal fashion.
Figure 7:
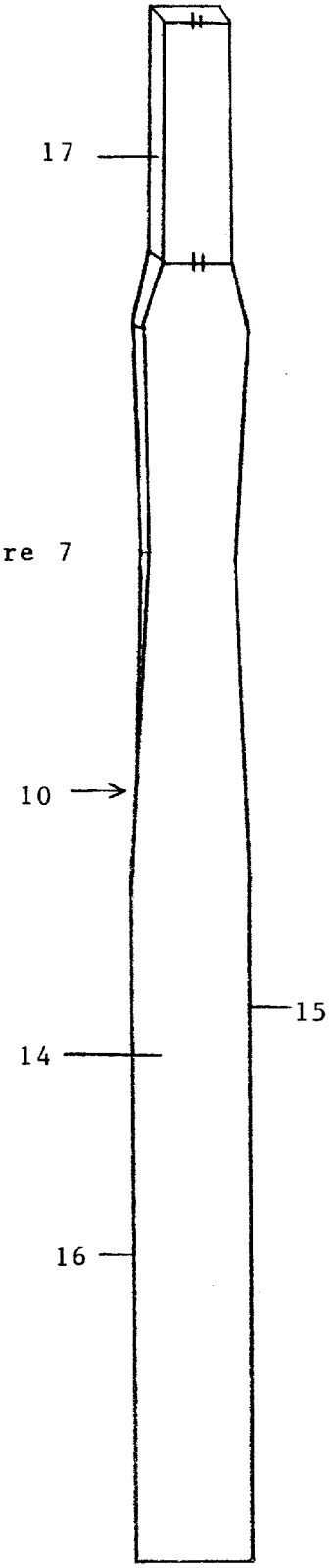
FIG. 7 is a side view of my invention in FIG. 1 with the pounding head removed to show features of my handle.

Referring to FIGS. 5 and 6, in order to align the pounding head and the pounding surface to the forearm, the angle β should be greater than or equal to 6.5° and less than or equal to 9.5°. In the preferred embodiment, the angle β is 8°. Due to the skeletal structure of the hand, grasping a typical handle for a pounding instrument in a normal fashion, with the fingers, other than the thumb, resting across the front portion of the handle, will turn the handle an angle θ from a line across the center of the forearm defined by the radius 19, θ being anywhere from 6.5° to 9.5°. By offsetting the pounding head 11 and the pounding surface 13 by the angle β, the misalignment between the pounding surface and the forearm resulting from the normal grasping of the handle is significantly reduced or eliminated.

The direction of the offset will differ depending upon whether the pounding instrument is to be used by a right handed user or a left handed user. When viewed from overhead, a right handed pounding instrument will be offset to the left of the second reference plane extending through the axial center of the handle, bisecting the handle along its front and rear portion. When viewed from overhead, a left handed pounding instrument will be offset to the right of the second reference plane extending through the axial center of the handle, bisecting the handle along its front and rear portion.

Figure 10:
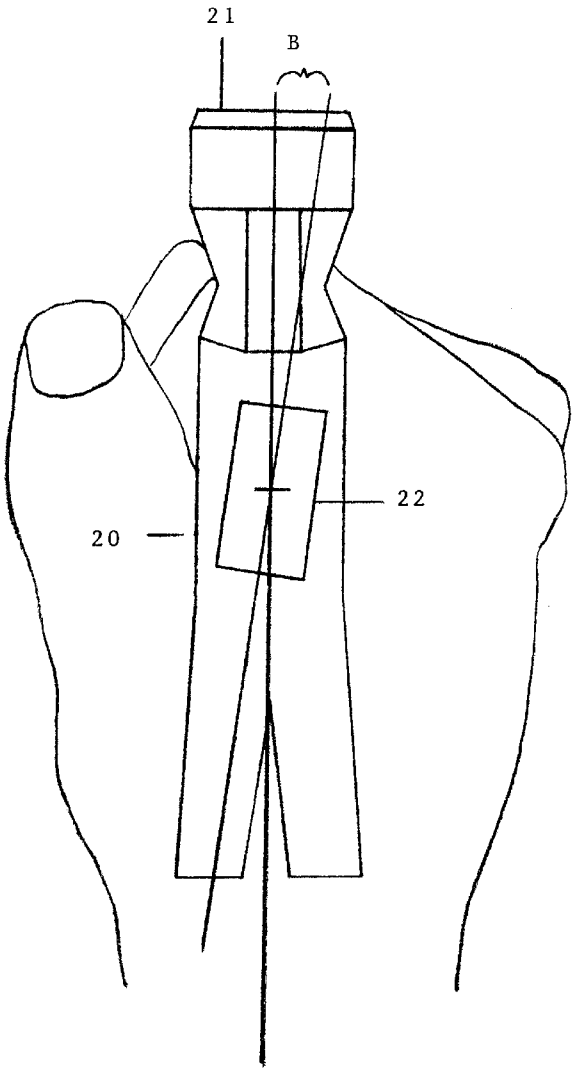
FIG. 10 is an overhead view of a right handed version of a second embodiment of my invention revealing features.
Figure 9:
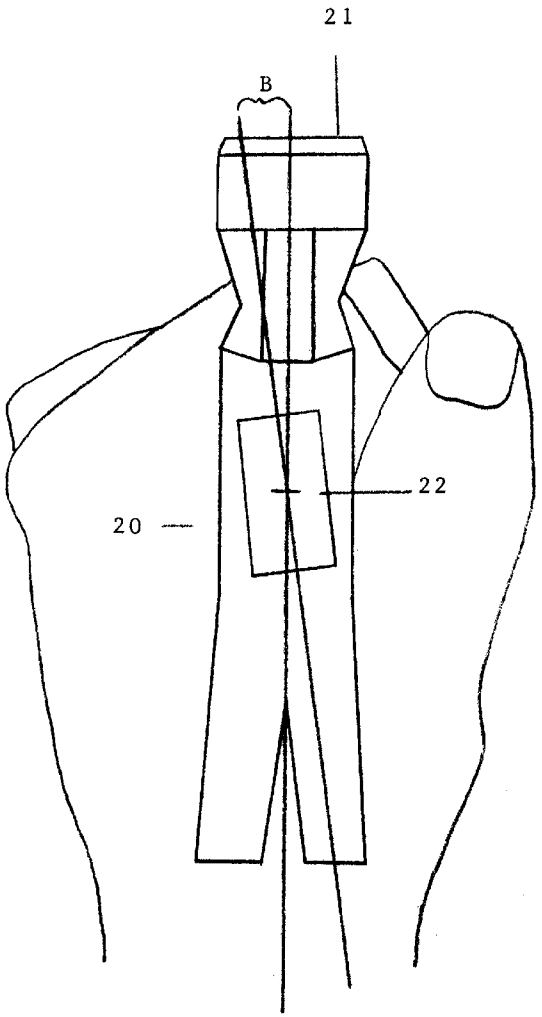
FIG. 9 is an overhead view of a left handed version of a second embodiment of my invention revealing features.

Referring to FIGS. 9 and 10, In a second embodiment, the offset is created in the offset pounding head 20 so that a standard non-offset pounding handle can be used. The offset pounding head 20 is comprised of a pounding surface 21 and an offset handle mount portion 22. The standard handle has a head mount portion which is disposed in the offset 15 handle mount portion 22 of the offset pounding head. The handle mount portion is offset so that an angle β is created between a first reference plane extending through the axial center of the pounding head, bisecting the pounding head, and a second reference plane extending through the axial center of the handle and bisecting the handle along its front and rear portion, the angle β being greater than or equal to 6.5° and less than or equal to 9.5°.

Once the pounding head and the pounding surface is aligned to the forearm. The pounding stroke can be changed to incorporate the forearm and minimize any movement of the wrist. The resulting pounding stroke will involve grasping the pounding instrument in a normal fashion, locking the wrist, and radially moving the forearm about the elbow. When viewed from the side, the forearm moves radially in a counterclockwise fashion to deliver a blow and moves radially in a clockwise fashion to recoil. The length of this new pounding stroke builds greater acceleration in the pounding head and the pounding surface, resulting in greater power being delivered with each blow. Furthermore, since there is no wrist manipulation involved in this new pounding stroke, greater accuracy can also be achieved with each stroke.

It is not intended that the novel device be limited thereby. The preferred embodiment and the second embodiment may be susceptible to modifications and variations that are within the scope and fair meaning of the accompanying claims and drawings.

I claim:

1. A right-handed pounding instrument, the pounding instrument comprising a pounding head and a handle, the handle having a front portion, a rear portion, and a head mount portion, the pounding head having a relatively planar pounding surface and being mounted onto the head mount portion of the handle, the head mount portion offset to enable the pounding head to be mounted onto the handle so that an angle β is created between a first reference plane extending through the axial center of the pounding head, bisecting the pounding head, and a second reference plane extending through the axial center of the handle and bisecting the front and rear portion of the handle, the angle β being greater than or equal to 6.5° and less than or equal to 9.5°, the pounding surface aligning to the radius in the right forearm when the handle is grasped by a user's right hand with the fingers, other than the thumb, resting across the front portion of the handle.

2. The right handed pounding instrument in claim 1 wherein the angle β is 8°.

3. A left-handed pounding instrument, the pounding instrument comprising a pounding head and a handle, the handle having a front portion, a rear portion, and a head mount portion, the pounding head having a relatively planar pounding surface and being mounted onto the head mount portion of the handle, the head mount portion offset to enable the pounding head to be mounted onto the handle so that an angle β is created between a first reference plane extending through the axial center of the pounding head, bisecting the pounding head, and a second reference plane extending through the axial center of the handle and bisecting the front and rear portion of the handle, the angle β being greater than or equal to 6.5° and less than or equal to 9.5°, the pounding surface aligning to the radius in the left forearm when the handle is grasped by a user's left hand with the fingers, other than the thumb, resting across the front portion of the handle.

4. The left handed pounding instrument in claim 3 wherein the angle β is 8°.

5. A right-handed pounding instrument, the pounding instrument comprising a head portion and a handle portion, the head portion having a relatively planar pounding surface and mounted onto the handle portion, the right handed pounding instrument ergonomically designed to align the pounding surface to the radius bone in the right forearm when the handle is grasped by a user's right hand with the fingers, other than the thumb, resting across the front portion of the handle.

6. The right handed pounding instrument in claim 5 wherein, the handle is comprised of a grip portion and a head mount portion, the head mount portion offset to enable the pounding head to be mounted onto the handle so that an angle β is created between a first reference plane extending through the axial center of the pounding head, bisecting the pounding head, and a second reference plane extending through the axial center of the handle and bisecting a front and rear portion of the handle, the angle β being greater than or equal to 6.5° and less than or equal to 9.5°.

7. The right handed pounding instrument in claim 6 wherein the angle β is 8°.

8. The right handed pounding instrument in claim 5 wherein the pounding head is comprised of a pounding surface and a handle mount portion, the handle mount portion offset so that when mounted to the handle, an angle β is created between a first reference plane extending through the axial center of the pounding head, bisecting the pounding head, and a second reference plane extending through the axial center of the handle and bisecting the handle along its front and rear portion, the angle β being greater than or equal to 6.5° and less than or equal to 9.5°.

9. A left-handed pounding instrument, the pounding instrument comprising a head portion and a handle portion, the head portion having a relatively planar pounding surface and mounted onto the handle portion, the left handed pounding instrument ergonomically designed to linearly align the pounding surface to the radius bone in the left forearm when the handle is grasped by a user's left with the fingers, other than the thumb, resting across the front portion of the handle.

10. The left handed pounding instrument in claim 8 wherein, the handle is comprised of a front portion, a rear portion and a head mount portion, the head mount portion offset to enable the pounding head to be mounted onto the handle so that an angle β is created between a first reference plane extending through the axial center of the pounding head, bisecting the pounding head, and a second reference plane extending through the axial center of the handle and bisecting a front and a rear portion of the handle, the angle β being greater than or equal to 6.5° and less than or equal to 9.5°.

11. The left handed pounding instrument in claim 10 wherein the angle β is 8°.

12. The left handed pounding instrument in claim 8 wherein the pounding head is comprised of a pounding surface and a handle mount portion, the handle mount portion offset so that when mounted to the handle, an angle β is created between a first reference plane extending through the axial center of the pounding head, bisecting the pounding head, and a second reference plane extending through the axial center of the handle and bisecting the handle along its front and rear portion, the angle β being greater than or equal to 6.5° and less than or equal to 9.5°.

13. A right handed pounding head for use with a standard handle in the construction of a pounding instrument, the right handed pounding head comprising a pounding surface and a handle mount portion, the handle mount portion offset so that when mounted onto a standard handle, an angle β is created between a first reference plane extending through the axial center of the pounding head, bisecting the pounding head, and a second reference plane extending through the axial center of the handle and bisecting the handle along its front and rear portion, the angle β being greater than or equal to 6.5° and less than or equal to 9.5°, the pounding head aligning to the radius bone in the right forearm when the handle is grasped by a user's right hand with the fingers, other than the thumb, resting across the front portion of the handle.

14. The right handed pounding head in claim 13 wherein the angle β is equal to 8°.

15. A left handed pounding head for use with a standard pounding handle in the construction of a pounding instrument, the left handed pounding head comprising a pounding surface and a handle mount portion, the handle mount portion offset so that when connected to a standard handle, an angle β is created between a first reference plane extending through the axial center of the pounding head, bisecting the pounding head, and a second reference plane extending through the axial center of the handle and bisecting the handle along its front and rear portion, the angle β being greater than or equal to 6.5° and less than or equal to 9.5°, the pounding head aligning to the radius bone in the left forearm when the handle is grasped by a user's left hand with the fingers, other than the thumb, resting across the front portion of the handle.

16. The left handed pounding head in claim 15 wherein the angle β is equal to 8°.

17. A right handed handle for use with a standard pounding head in the construction of pounding instruments, the handle comprising of a front portion, a rear portion, and a head mount portion, the head mount portion offset to enable a standard pounding head to be mounted onto the handle so that an angle β is created between a first reference plane extending through the axial center of the pounding head and bisecting the pounding head and a second reference plane extending through the axial center of the handle, bisecting the handle along its front and rear portion, the angle β being greater than or equal to 6.5° and less than or equal to 9.5°, the handle aligning the pounding head to the radius in the right forearm when grasped by a user's right hand with the fingers, other than the thumb, resting across the front portion of the handle.

18. The right handed handle in claim 17 wherein the angle β is equal to 8°.

19. A left handed handle for use with a standard pounding head in the construction of pounding instruments, the handle comprising of a front portion, a rear portion, and a head mount portion, the head mount portion offset to enable a standard pounding head to be mounted onto the handle so that an angle β is created between a first reference plane extending through the axial center of the pounding head and bisecting the pounding head and a second reference plane extending through the axial center of the handle, bisecting the handle along its front and rear portion, the angle β being greater than or equal to 6.5° and less than or equal to 9.5°, the handle aligning the pounding head to the radius in the left forearm when grasped by a user's left hand with the fingers, other than the thumb, resting across the front portion of the handle.

20. The left handed handle in claim 19 wherein the angle β is equal to 8°.

21. A pounding instrument, the pounding instrument comprising a pounding head and a handle, the handle having a front portion, a rear portion, and a head mount portion, the pounding head having a relatively planar pounding surface and being mounted onto the head mount portion of the handle, the pounding head mounted onto the handle at an offset so that an angle β is created between a first reference plane extending through the axial center of the pounding head, bisecting the pounding head, and a second reference plane extending through the axial center of the handle and bisecting the front and rear portion of the handle, the angle β being greater than or equal to 6.5° and less than or equal to 9.5°.

22. The pounding instrument in claim 21 wherein the pounding surface aligns to the radius in the right forearm when the handle is grasped by a user's right hand with the fingers, other than the thumb, resting across the front portion of the handle.

23. The pounding instrument in claim 21 wherein the pounding surface aligns to the radius in the left forearm when the handle is grasped by a user's left hand with the fingers, other than the thumb, resting across the front portion of the handle.

* * * * *